United States Patent [19]

Whiteford

[11] 3,986,260

[45] Oct. 19, 1976

[54] KNIFE HAVING REPLACEABLE EDGE AND HOLDING BASE THEREFOR

[76] Inventor: Carlton L. Whiteford, 3 Highpoint Road, Westport, Conn. 06880

[22] Filed: Apr. 23, 1975

[21] Appl. No.: 570,647

[52] U.S. Cl. ..... 30/296 A; 30/349

[51] Int. Cl.[2] ..... B26B 5/00

[58] Field of Search ..... 30/296 R, 296 A, 335, 30/336, 349, 40, 40.2; 248/37.3, 37.6; 211/60 T; 206/354, 355, 359; D7/148, 151

[56] References Cited

UNITED STATES PATENTS

| | | | |
|---|---|---|---|
| 914,707 | 3/1909 | Duhring | 30/336 |
| 1,124,690 | 1/1915 | Barnett | 30/349 |
| 1,813,686 | 7/1931 | Stetson | 206/354 |
| 3,835,532 | 9/1974 | Petrillo | 30/40.2 |
| 3,854,201 | 12/1974 | Dawidowicz | 30/40.2 |

*Primary Examiner*—Al Lawrence Smith
*Assistant Examiner*—J. C. Peters
*Attorney, Agent, or Firm*—Mattern, Ware, Davis & Stoltz

[57] ABSTRACT

A cutting system utilizes a cutting blade-holding base that removably holds a number of long razor cutting blades in a corresponding number of longitudinal slots. A replaceable blade knife of the cutting system has a cutting blade-gripping member with a bifurcated lower region extending throughout its length and dimensioned for resiliently gripping one of the long razor blades. The blades are placed within the blade-gripping member of the cutting knife by placing the heel end portion of the bifurcated region over the razor blade at this point and then angling downward so that the remainder of the bifurcated region resiliently grips the cutting blade throughout its entire length. The cutting blade-holding base also serves to store the knife with its cutting blade by insertion of the blade into an empty slot of the base. Removal of the cutting blade from the knife is accomplished by placing the blade in an empty slot of the blade-holding base and sliding the knife backwards so as to engage the cutting blade with a blade-stop portion of the base; whereby the cutting blade remains within the slot of the base while the knife slideably disengages from the cutting blade.

26 Claims, 14 Drawing Figures

20
26
22
24
16
27
14
49
7
53
54
52
39

12
14'
16
20
22
50
52'
54'
56
58
60
62
64
13
14

KNIFE HAVING REPLACEABLE EDGE AND HOLDING BASE THEREFOR

BACKGROUND OF THE INVENTION

The present invention relates to a cutting system comprising a base that holds a plurality of long cutting razor blades, and a replaceable blade knife with a handle and a cutting blade-gripping member connected to the handle. The blade-gripping holding portion is adapted for receipt of the cutting blades held in the base as well as removal of dull cutting blades from the knife into empty slots of the cutting blade-holding base. Although there are many prior art patents related to razor blade holding apparatus, none of the prior art patents disclose or suggest a cutting system incorporating a cutting blade-holding base with longitudinal slots adapted for holding a plurality of cutting razor blades and a knife incorporating a lower bifurcated region adapted for receipt of these cutting carving blades and for removal of the cutting blades back into the cutting blade-holding base. Thus, although U.S. Pat. No. 1,090,398, Humeston discloses a razor blade holder, it does not disclose a blade-holding base nor means for slideably removing a cutting razor blade from the razor blade holder.

Similarly, U.S. Pat. Nos. 1,391,842, Lightfoot, 1,711,569, Kinney, 2,053,625, Nichols, 2,267,934, Lockett, 2,637,904, Springer, and 3,085,331, Gignilliat, Jr., disclose devices adapted for holding a razor blade but they do not disclose the use of a blade-holding base with elongated slots for holding long cutting razor blades and a carving knife having a lower bifurcated region for resiliently gripping these stored razor blades. They also do not disclose a blade-stop portion in the razor blade-holding holding base for removal of dulled blades from the knife by placing them in empty slots of the base and slideably moving the knife so as to cause the cutting blades to abut against this blade-stop portion and thereby leave and store the dull blades in the blade-holding base.

SUMMARY OF THE INVENTION

A cutting system of the present invention incorporates a cutting blade-holding base, a plurality of long razor-sharp cutting blades held by the blade-holding base, and a replaceable blade knife having a handle and a blade gripping member incorporating a lower elongated bifurcated region for gripping a cutting razor blade from the blade-holding base. The blade-holding base incorporates a blade-stop portion for each elongated slot of the base that holds one cutting blade. The blade-stop is used during removal of a dulled or chipped cutting blade from the knife by inserting the cutting blade in a blade-holding slot of the base and slideably moving the knife, by its handle, parallel to this portion of the base so as to contact the dulled razor blade against the blade-stop and thereby leaving it in its protective slot in the blade-holding base, while at the same time, removing it from the knife.

In one embodiment of the present invention, the blade-holding base comprises a rectangular cross-sectional solid having an upper planar surface and a plurality of elongated slots. These slots terminate at their rearward ends prior to termination of the blade-holding base, thereby forming a plurality of blade-stops in the base. Insertion of a cutting blade in the knife holder blade using this version of the blade-holding base is easily accomplished by placing the rearward or heel portion of the bifurcated region of the blade-holding member of the knife over the upper rearward edge of one of the cutting blades in the blade-holding base and camming the knife forward so as to contact the innermost portion of the groove defined by the bifurcated region with the upper edge of the cutting blade.

At this point, the selected razor cutting blade is resiliently gripped by the blade-gripping portion of the knife and may be removed from the elongated slot of the blade-holding base by simply lifting the knife from the base in an upward and slightly forward manner, away from the blade stop portion of the base.

Removal of a dull razor blade within the knife is also easily accomplished. To remove a dull razor blade, the knife is positioned so as to place the dull razor blade within an empty slot of the blade-holding base. The knife is then simply slid in a direction parallel to the blade-holding base so as to abut the back angled end of the dull blade against the blade-stop in the base. Thus, the cutting blade is unable to continue to move backward with the knife and is held by the blade-holding base while the knife is slideably detached from the dulled carving blade. The presence of a dull or used cutting blade in the base is indicated by the breaking of a blade indicator tab at the end of the slot. This tab is broken away by the knife during removal of a dull cutting blade.

In another embodiment of the present invention, the blade-holding base is of an elongated four-sided configuration comprising a plurality of slotted members dimensioned for receipt of the cutting razor blades. A centrally located end cap is resiliently abutted against the forward ends of the razor blades so as to protect these ends from damage as well as to protect the user from accidental cutting. The rear-ward portion of this embodiment of the blade-holding base comprises a blade-stop as well as radially protruding tabs for indication of which blades are new and which are dull. Insertion of a cutting blade in an empty knife is accomplished by pushing the heel of the knife against the back end of a cutting razor blade, and then camming downward, throughout its length until the end cap is reached. The protective enc cap is then manually pulled out against the spring bias means holding it against the remainder of the blade-holding base so as to allow the forward portion of the blade to be gripped. Raising of the knife then removes the selected razor blade gripped by the knife. Once this blade becomes dull, it may be reinserted in an empty slotted member of this blade-holding base by again pulling the end cap outward against the spring bias and then moving the knife in a direction parallel to this slotted member so as to cause the dull razor blade to abut against the blade-stop for this slotted member. The knife is then slideably removed from the dull cutting blade.

In both embodiments of the blade-holding base, the raised tabs at the rearward regions of the elongated slots are broken off when the knife is slideably moved in a parallel direction to the elongated slot during the removal operation of a dull cutting blade. The broken tab then indicates to the user that this particular blade is dull, or has been used. Likewise, the fact that a tab is not broken off indicates to the user that the razor blade in that slot is new and is ready for insertion in the knife.

Thus, the present invention incorporates a new and unique cutting system utilizing a blade-holding base that holds a plurality of long razor blades which are used as the cutting edge for a knife. The knife incorporates a lower elongated bifurcated region in its blade-gripping member so as to resiliently grip a selected razor blade, thereby forming an extremely sharp and durable knife. Removal of dull razor blades from the knife is easily accomplished by placement in an empty slot of the blade-holding base and slideably disengaging the knife from this dull razor blade through use of the blade-stop for that particular elongated slot of the blade-holding base.

OBJECTS OF THE INVENTION

Thus, a principal object of the present invention is to provide a cutting system utilizing a razor blade-holding base that stores a plurality of elongated cutting razor blades which are inserted in a knife and are easily moved from the knife to the razor blade-holding base when they become dull.

Another object of the present invention is to provide a cutting system of the above description wherein the razor blade-holding base safely stores a plurality of new razor carving blades as well as providing a simple and safe means for inserting these razor blades into the knife and for easy and safe removal of dull blades from the knife back into the razor blade-holding base.

A further object of the present invention is to provide a cutting system of the above description wherein the razor blade-holding base is of a rectangular cross-sectional configuration adapted to be firmly fastened to a horizontal or vertical surface, comprising a multiplicity of elongated slots for receipt of a plurality of razor blades.

Another object of the present invention is to provide a cutting system of the above description having a blade-holding base with a star-shaped configuration incorporating a plurality of slots, each slot adapted for holding a long razor blade.

A further object of the present invention is to provide a cutting system of the above description that is inexpensive to manufacture.

Another object of the present invention is to provide a cutting system of the above description that may be easily mounted in a kitchen.

Other objects of the present invention will in part be obvious and will in part appear hereinafter.

THE DRAWINGS

For a further understanding of the nature and objects of the invention, reference should be had to the following detailed description taken in conjunction with the accompanying drawings in which.

DETAILED DESCRIPTION

Figure 1:
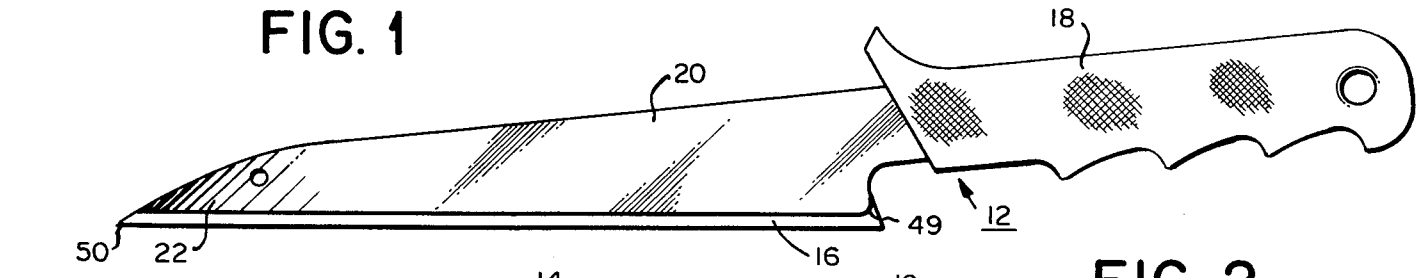
FIG. 1 is a side view of the replaceable blade knife of the present invention with a cutting razor blade inserted therein.
Figure 2:
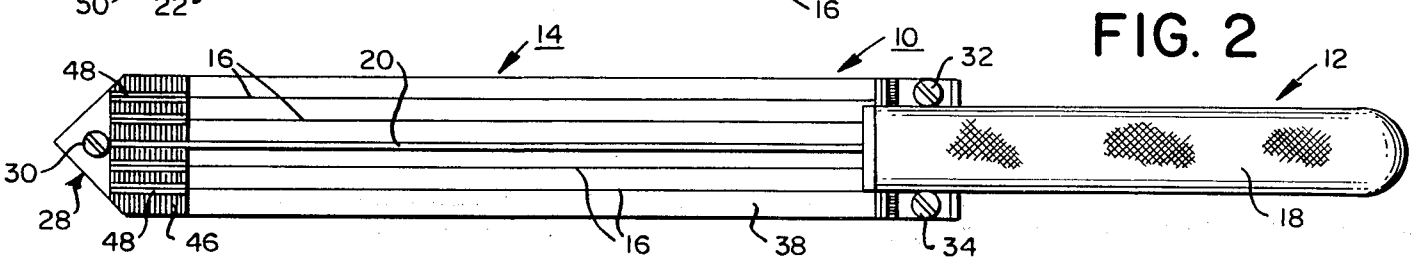
FIG. 2 is a top view of the cutting system of the present invention with the knife stored in one of the elongated slots of the base.

As may best be seen in FIGS. 1 and 2, a cutting system 10 of the present invention incorporates a replaceable blade knife 12, a blade-holding base 14, and long cutting razor blades 16 having lower razor edges 17. The knife comprises a handle 18 and a blade-gripping member 20. The handle may have a knurled or cross-hatched surface and the blade-gripping member may be fabricated from graphite fiber composite material. This material has a tensile strength and tensile modulus density four times greater than steel while having a much lower specific gravity. It is thus ideally suited for fabrication of the blade-gripping member.

Figure 3:
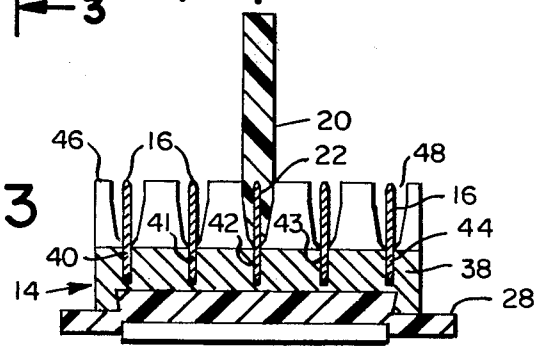
FIG. 3 is a cross-sectional view of the cutting system of FIG. 2 taken along line 3—3 of FIG. 4.
Figures 6, 7, 8, 9, 10:
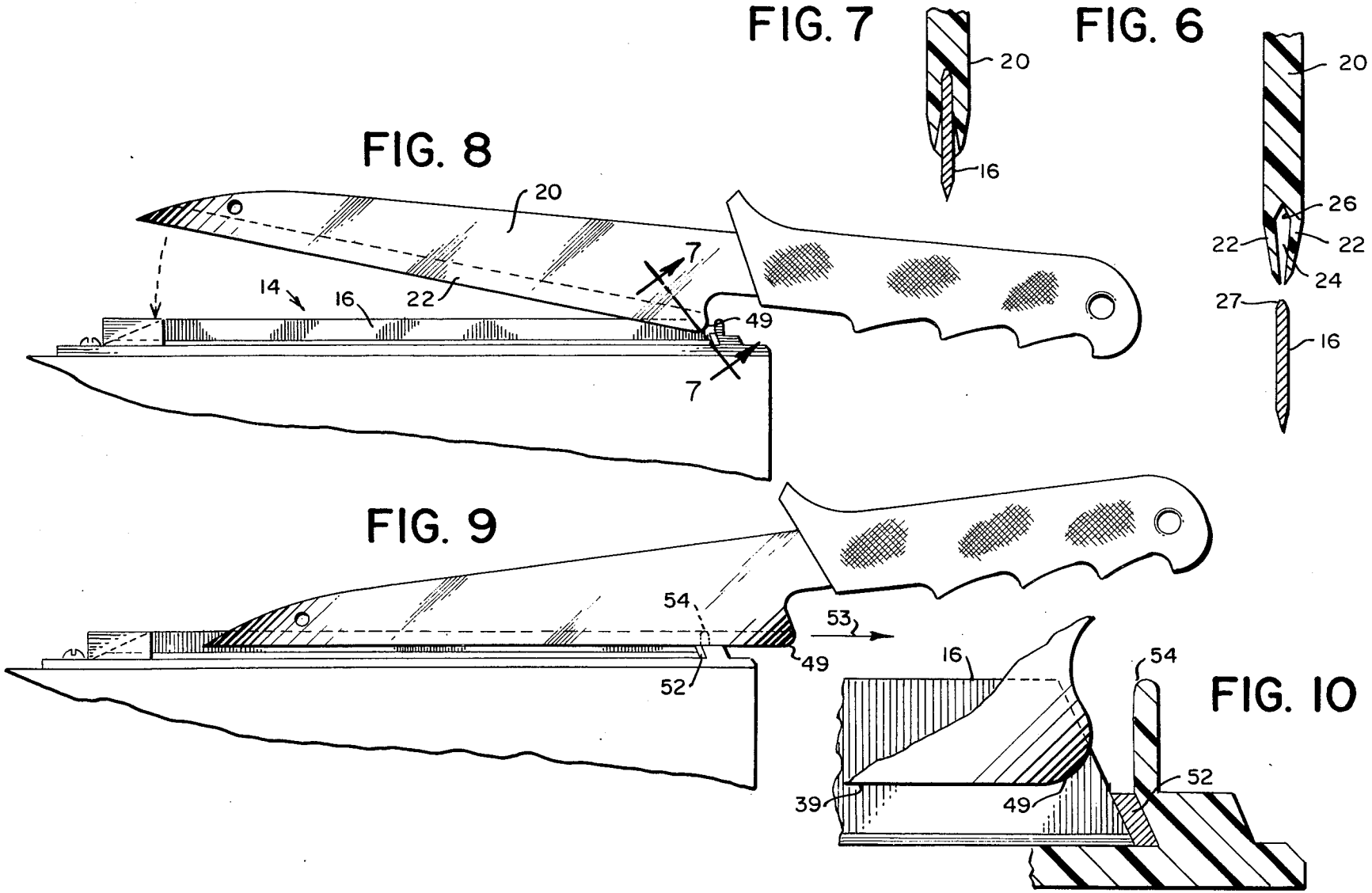
FIG. 6 is an enlarged partial cross-sectional front view of the knife of FIG. 1 showing a razor blade before insertion in the knife.
FIG. 7 is an enlarged partial cross-sectional front view of the knife of FIG. 1 taken along line 7—7 of FIG. 8, showing the razor blade inserted within the knife.
FIG. 8 is a side elevational view of the cutting system of FIG. 2 showing the insertion of a razor blade within the knife.
FIG. 9 is a side elevational view of the cutting system of FIG. 2 showing the removal of a dull razor blade from the knife and the storage of the dull blade within the blade holding base.
FIG. 10 is an enlarged cross-sectional side view of the rearward portion of the blade-holding base of FIG. 2 showing the placement of the knife prior to removal of a dull razor blade from the knife and showing a portion of the blade on the upper surface of the base in phantom.

As best seen in FIG. 3, the blade-gripping member of the knife has a bifurcated lower region 22 that is adapted for resiliently gripping elongated razor blades 16. As best seen in FIG. 6, the bifurcated region of the blade-gripping member forms a blade-holding groove 24 which extends throughout the lower portion of the blade-gripping member 20. The blade-holding groove has an innermost V-configuration 26 which mates with a V-shaped upper edge 27 of the blade 16. As best seen in FIG. 1, the bifurcated lower region 22 of the blade-gripping member 20 extends throughout the lower length of the blade-gripping member in order for the razor blades to extend throughout the lower region of this member.

Figure 4:
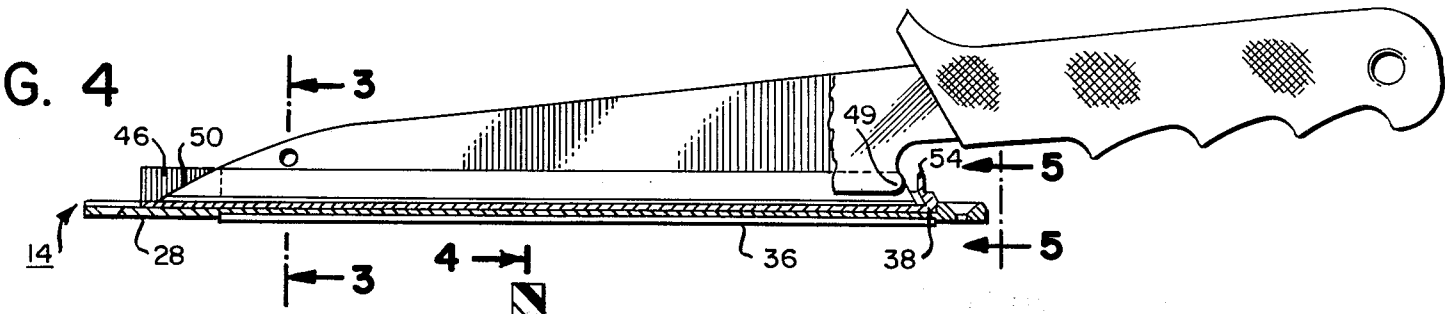
FIG. 4 is a cross-sectional side view, partially cut away, of the cutting carving system of FIG. 2 taken along line 4—4 of the FIG. 3.

As best seen in FIGS. 2, 3, and 4, the blade-holding base 14 has a mounting frame 28 which may preferably incorporate mounting apertures for insertion of mounting screws 30, 32, and 34. The frame is preferably constructed from wood or plastic. Beneath a portion of the mounting frame, a wafer of adhesive material 36, such as foamed stickum material, may be placed so as to allow mounting of the blade-holding base on a portion of a wall or countertop made of glass, porcelain or other hard surface material. Above the mounting frame, a blade-storing block 38, preferably of wood or plastic, is attached which incorporates a number of longitudinal slots 40, 41, 42, 43, and 44, which are dimensioned for receipt of a number of razor blades 16. These slots store new and dull razor blades in a manner that allows easy insertion and removal of the razor blades from the carving knife 12, as will be explained later.

As also seen in FIGS. 2, 3, and 4, the forward portion of the blade-holding base 14 incorporates a shield 46 that comprises a number of elongated U-shaped grooves 48 which have a height equal to the height of the blades when placed in the blade-holding base, as well as extending forwardly beyond the forward termination of the blade in order to protect the user from this portion of the blade which, as shown in FIG. 1, terminates with a sharp region 50. The U-shaped grooves have a configuration which frictionally grip the forward portion of the blade-holding member of the knife when it is stored in the blade-holding base 14, as best shown in FIGS. 2 and 3.

The insertion and removal of razor blades within the replaceable blade knife, as well as the storage of new and dull blades by the blade-holding base is best understood with reference to FIGS. 3, 4, 5, 6, 7, 8, 9, and 10. As best seen in FIGS. 7 and 8, a new razor blade is inserted in the knife by inserting the rearward rounded portion 49 of the bifurcated lower region 22 of blade-holding member 20 over a new razor blade 16. Once the blade is inserted in this matter, the knife may be pivoted about this rounded portion of the bifurcated lower region of the blade-gripping member in a manner as indicated in FIG. 8, thereby causing the bifurcated lower region to grip the razor blade throughout the entire length of the blade-gripping member. The depth of the blade-gripping groove 24 is slightly less than the protruding height of the cutting blade extending above the blade storing block 38, thereby ensuring that the V-shaped portion of groove 24 securing mates with the V-shaped upper edge 27 of the cutting blade.

Once the new razor blade is firmly inserted within the bifurcated region of the knife, the knife may be easily lifted from the blade-holding base 14. In this configuration, the knife appears as shown in FIG. 1. It is evident that this knife, with its new razor edge 17, is extremely sharp and may be used for a multiplicity of purposes, such as carving and chopping. It should be noted that the knife may include a high frequency vibrator (not shown) within its handle or blade-holding member so as to transform the knife into a power carving knife.

The knife, with its sharp cutting blade and razor edge, may easily and safely stored in the blade-holding base by simply placing it in the empty longitudinal slot of the blade-holding base from which the new cutting blade was obtained by the knife. Thus, the cutting system allows easy insertion of the cutting razor blade within the knife as well as a place to safely store the knife.

Figure 5:
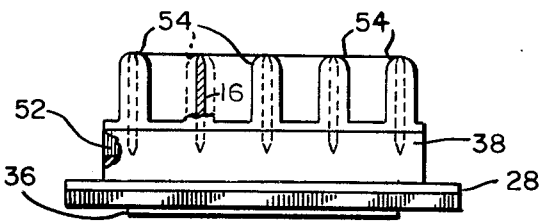
FIG. 5 is a rear view of the cutting system of FIG. 2 taken along line 5—5 of FIG. 4 showing new blades and a broken away tab in phantom.

After considerable use of the knife, the razor edge of the cutting blade may become dull. Any cutting edge eventually exhibits this property, and therefore, the present invention provides a unique solution to the problem by providing a cutting system that allows a knife to dispense with a blade having a dull edge in a safe receptacle, as well as to quickly and safely receive a new cutting blade having a new razor edge. The removal of a dull cutting blade from the knife is best understood with reference to FIGS. 4, 5, 9, and 10. As shown in FIG. 4, the knife is simply placed in one of the empty longitudinal slots of the blade-holding base. This step is similar to storing the knife in the blade-holding base. However, if the cutting razor blade is dull, the knife is then moved in a parallel rearward direction as indicated by arrow 53 in FIG. 9. When this is completed, the dull razor blade abuts against a blade-stop 52 of the blade-holding base 14, as best seen in FIG. 10. This blade-stop is preferably a metal insert and, as shown in FIG. 5, extends in a transverse direction behind the longitudinal slots of the blade holding base. Thus, the blade-stop is in effect a rearward termination of the longitudinal slots that are used to hold the razor blades. The continued rearward movement of the knife, as shown in FIG. 9, removes the dull razor blade from the bifurcated region of the blade-holding portion of the carving knife. The knife simply slides away from the dull razor blade and it is effectively and safely stored by the blade-holding base.

As best seen in FIGS. 4, 5, 9, and 10, the blade-storing block 38 of the blade-holding base 14 may preferably include a number of blade indicator tabs 54 that protrude upwardly directly behind each of the longitudinal slots 40, 41, 42, 43, and 44 of the blade-holding base. When a dull razor blade is removed from the knife, the rearward sliding movement of the knife causes the corresponding tab to break off, thus indicating to the user that the razor blade in that particular slot of the blade-holding base is dull. Thus, as shown in FIG. 5, the second cutting razor blade 16, in slot 41, is dull while the remaining cutting razor blades in the base are new. Thus, the cutting system of the present invention provides safe storage for new and dull razor blades in the blade-holding base, easy insertion of new cutting blades into the knife, simple and safe removal of dull cutting blades from the knife, and an indication to the user as to which razor blades in the blade-holding base are new and which are dull.

Figures 11, 12, 13, 14:
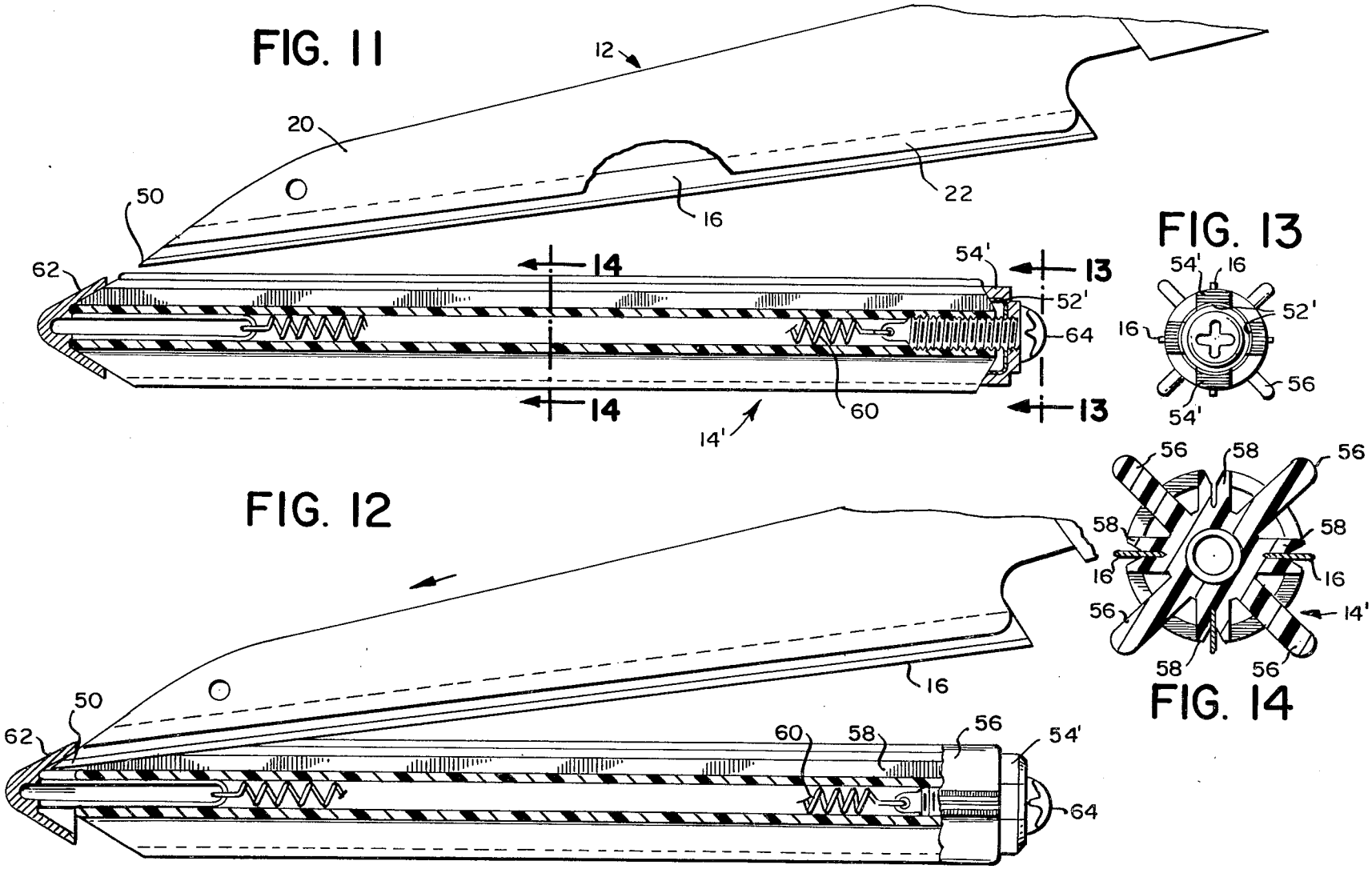
FIG. 11 is a cross-sectional side view, partially cut away, of an alternate portable embodiment of the blade-holding base of the cutting system of the present invention.
FIG. 12 is a cross-sectional side view of an alternate portable embodiment of the blade-holding base of the present invention as shown in FIG. 11, showing the knife moving the end cap of the blade-holding base against the bias force of the resilient spring within the base.
FIG. 13 is an end view of the blade-holding base of FIG. 11 taken along line 13—13 of FIG. 11.
FIG. 14 is an enlarged cross-sectional view of the blade-holding base of FIG. 11 taken along line 14—14 of FIG. 11.

An alternate embodiment of the blade-holding base 14 is best shown in FIGS. 11, 12, 13, and 14 where the blade-holding base 14' is of four-sided configuration. It is apparent to a person skilled in the art that other multi-sided configurations may also be used. As seen in FIG. 14, the blade-holding base 14' includes a set of four radially projecting longitudinal ribs 56 and a like number of radially projecting longitudinal blade-holding slotted members 58. These slotted members serve an analogous function to the longitudinal slots 41, 42, 43, and 44 of the planar version of the blade-holding base.

The central region of the blade-holding base 14' is hollow and incorporates a spring 60 which is attached to a forward end cap 62. This cap protects the user from the sharp ends 50 of the razor blades, when ported. The rearward portion of the spring is connected to a machine screw 64. Between the machine screw 64 and the blade-holding base 14' is a blade-stop member 52' and a number of blade indicator tabs 54'.

Thus, a razor blade may be easily inserted into the knife by forcing the rearward or heel portion 49 of the blade-gripping member 20 of the knife, down over a new sharp razor blade, and camming forward until the entire length of the bifurcated blade-gripping member 20 has been firmly seated over the new razor blade 16. This insertion of a new cutting blade in the blade-gripping member is analogous to the insertion of blades stored in the planar blade-holding base 14, and reference may therefore be had to FIG. 7 and line 7—7 of FIG. 8 as to insertion of the blade in the knife. Once the blade is fully inserted within the knife, the razor edge knife may be simply removed from the blade-holding base 14'.

After a razor blade becomes dull in the knife, it may easily be removed in a manner analogous to the removal of the blade in the planar version of the blade-holding base. In the present alternate embodiment, the knife is placed under a quadrant of the end cap 62 as best shown in FIG. 12. The end cap is forced away from the blade-holding base and the knife with the carving blade is placed in an empty slot of one of the blade-holding slotted members 58. The knife is then moved in a rearward parallel fashion with respect to the blade-holding member, thereby breaking the corresponding blade indicator tab 54' while leaving the dull razor blade in the blade-holding slotted member due to the contact of the back end of the razor blade with the blade-stop 52'. Thus, this alternate version of the blade-holding base provides the same functions as that in the planar blade-holding base previously described, in that it stores new razor blades while allowing for the easy insertion of new razor blades into the knife and also allows for the easy removal of dull razor blades from the knife while safely storing old razor blades in the blade-holding base 14'.

Thus, the present invention provides a new and unique cutting system incorporating a blade-holding base in which a number of razor blades are stored, and a knife adapted for use with the blade-holding base so as to obtain a new razor blade and edge for the carving knife as well as a safe depository for dull blades. Furthermore, the blade-holding base may, in one version of the invention, be mounted to a counter top or a wall and the knife may be easily stored in one of the slots of the blade-holding base of this version of the present invention. Thus, a cutting system has been described which allows for an extremely sharp tool that is very safe to handle and very safe to store, as well as easy to use, and having the major new advantage of quickly and simply acquiring a new inexpensive razor shart cutting edge, when needed.

It will thus be seen that the objects set forth above, among those made apparent from the preceding description, are efficiently attained and, since certain changes may be made in the above construction without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

I claim:

1. A cutting system comprising:

A. a base incorporating:

1. a plurality of elongated slot forming members, each slot terminating at a first end prior to termination of the base; and
2. a plurality of blade stops positioned at the termination of each elongated slot so as to prevent a blade stored in the corresponding slot from longitudinal movement in the slot beyond the blade stop;

B. a plurality of long razor blades each having a lower razor edge dimensioned for storage in one of the slots of the base and having a substantially straight upper edge protruding above the upper surface of the slot forming member when stored in said member; and C. a knife having:

1. a handle; and
2. a razor blade-gripping member connected to the handle, having a lower elongated bifurcated region forming an elongated groove having a depth less than the height of the protruding portion of a blade stored in a slot forming member, and dimensioned for gripping engagement with said razor blades; whereby the knife receives a long razor blade stored in one of the elongated slots of the base and deposits dull razor blades in one of the empty slots by positioning the dull razor blade gripped in the knife in an empty slot and moving the knife in a direction that causes the dull razor blade to abut the blade-stop corresponding to the slot in which the blade is placed.

2. A cutting system as defined in claim 1, wherein the slot-forming members are parallel to each other.

3. A cutting system as defined in claim 2, wherein the base further incorporates:

3. a lower planar surface of adhesive material for adhering the base to a flat surface.

4. A cutting system as defined in claim 2, wherein the base further incorporates:

3. a shield having a plurality of elongated U-shaped grooves, each groove in alignment with one of the slots of the base and wherein the shield is mounted to the slot-forming members at their ends of greatest distance from the blade-stops whereby the blade-gripping member of the knife is resiliently gripped by one of the elongated U-shaped grooves of the shield when the knife is placed in one of the empty slots of the base.

5. A cutting system as defined in claim 2, wherein the base further incorporates:

3. mounting apertures for securing the base to an external structure.

6. A cutting system as defined in claim 2, wherein the blade stops are formed from a rectangular metal insert laterally positioned across the termination of the first ends of said slots.

7. A cutting system as defined in claim 2, wherein the lower elongated bifurcated region of the blade-gripping member of the knife has a rounded end nearest the handle for facilitating initial gripping of a razor blade stored in the base.

8. A cutting system as defined in claim 1, wherein the base further incorporates:

3. a plurality of blade indicator tabs each in alignment with the termination of one of the slots in the base and protruding above the upper surface of the corresponding slot forming member so as to be broken away from the blade-holding base when the knife is removed during removal of a dull razor blade from the knife in a formerly empty slot of the base.

9. A cutting system as defined in claim 1, wherein the elongated slot-forming members are arranged in a multi-sided configuration.

10. A cutting system as defined in claim 9, wherein the base further comprises an end cap resiliently positioned over the other terminating end of the slots so as to cover one end of the razor blades stored within the elongated slots.

11. A cutting system as defined in claim 1, wherein the blade-gripping member of the knife is fabricated from a graphite fiber composite material.

12. A cutting system as defined in claim 11, wherein the handle of the knife is fabricated from plastic.

13. A cutting system comprising:

A. a base incorporating:

1. a plurality of elongated slot-forming members, each slot terminating at one end prior to termination of the base;
2. blade-stops at the location of termination of each elongated slot so as to prevent a blade stored in the corresponding slot from longitudinal movement in the slot beyond the blade stop; and
3. blade indicator tabs, each in alignment with the termination of one of the elongated slots in the base and extending outwardly above the upper surface of the corresponding elongated slot-forming member;

B. a plurality of long razor blades each having a lower razor edge dimensioned for storage in one of the slots of the base and having a substantially straight upper edge extending outwardly above the upper surface of the elongated slot-forming member when placed in the respective slot of said member; and C. a knife having:

1. a handle; and
2. a blade-gripping member connected to the handle, having means for removably gripping the portion of a razor blade extending outwardly from the slot-forming member;

whereby movement of the knife in a direction parallel to the slot-forming member contacts and breaks the blade indicator tab while the blade abuts the corresponding blade-stop, thereby removing the razor blade from the knife while indicating that the razor blade in the slot has been removed from the knife.

14. A cutting system as defined in claim 13, wherein the slot forming members are parallel to each other.

15. A cutting system as defined in claim 14, wherein the blade stops are formed from a rectangular insert laterally positioned across the termination of the first ends of said slots.

16. A cutting system as defined in claim 13, wherein the means for removably gripping the extending portion of a razor blade includes a lower elongated bifurcated region forming an elongated groove having a depth less than the height of the extending portion of the razor blade stored in a slot forming member of the base and having a rounded end nearest the handle for facilitating initial gripping of said razor blade stored in the base.

17. A cutting system as defined in claim 13, wherein the elongated slot-forming members are arranged in a multi-sided configuration.

18. A cutting system as defined in claim 17, wherein the base further comprises:

4. an end cap resiliently positioned over the other terminating end of the slots of the slot-forming members so as to cover one end of the razor blades stored within said slots.

19. A cutting system as defined in claim 13, wherein the blade-gripping member of the knife is fabricated from a graphite fiber composite material.

20. A cutting system comprising:

A. a base incorporating:

1. at least two elongated slot forming members, each slot terminating at a first end prior to termination of the base; and
2. blade stops positioned at the termination of each elongated slot so as to prevent a blade stored in the corresponding slot from longitudinal movement in the slot beyond the blade stop;

B. a plurality of long naked razor blades each having a lower razor edge dimensioned for storage in one of the slots of the base and having an upper edge protruding above the upper surface of the slot forming member when stored in said member; and C. a knife having:

1. a handle; and
2. a razor blade gripping member connected to the handle, having a lower elongated resiliently bifurcated region forming an elongated groove and dimensioned for gripping engagement with said long razor blades;

whereby the knife receives a long razor blade stored in one of the longitudinal slots of the base and deposits a dull razor blade in one of the empty longitudinal slots by placing the dull blade in an empty longitudinal slot and moving the knife in a direction that causes the dull razor blade to abut the blade-stop corresponding to the slot in which the blade is placed.

21. A cutting system as defined in claim 20 wherein the slot forming members are parallel to each other and combine with each other to form a planar upper surface.

22. A cutting system as defined in claim 21, wherein the blade stops are formed from a rectangular metal insert laterally positioned across the termination of the first ends of said slots in a groove in the base substantially perpendicular to the elongated slot forming members.

23. A cutting system as defined in claim 20, wherein the lower elongated bifurcated region of the blade-gripping member of the knife has a rounded end near the handle for facilitating initial gripping of a razor blade stored in the base.

24. A cutting system for use with razor blades comprising:

A. a base incorporating:

1. at least two elongated slot forming members, each slot terminating at a first end prior to termination of the base;
2. blade stops positioned at the termination of each elongated slot so as to prevent a blade stored in the corresponding slot from longitudinal movement in the slot beyond the blade stop; and
3. blade indicator tabs each in alignment with the termination of one of the slots in the base and protruding above the upper surface of the corresponding slot forming member, so as to be broken away from the blade-holding base when the knife is moved during removal of a razor blade from the knife; and B. a knife having:

1. a handle; and
2. a razor blade gripping member connected to the handle, having a lower elongated bifurcated region forming an elongated groove having a depth less than the height of the protruding portion of the blades when stored in the longitudinal slots of the base, and dimensioned for gripping engagement with said long razor blades;

whereby the knife receives a long razor blade stored in one of the longitudinal slots of the base and deposits a dull razor blade in one of the empty longitudinal slots by placing the dull blade in an empty longitudinal slot and moving the knife in a direction that causes the dull razor blade to abut the blade stop corresponding to the slot in which the blade is placed.

25. A cutting system for use with razor blades comprising:

A. a base incorporating:

1. at least two elongated slot forming members arranged in a multi-sided configuration, each slot terminating at a first end prior to termination of the base; and
2. blade stops positioned at the termination of each elongated slot so as to prevent a blade stored in the corresponding slot from longitudinal movement in the slot beyond the blade stop; and B. a knife having:

1. a handle; and
2 a razor blade gripping member connected to the handle, having a lower elongated bifurcated region forming an elongated groove having a depth less than the height of the protruding portion of the blades when stored in the longitudinal slots of the base, and dimensioned for gripping engagement with said long razor blades;

whereby the knife receives a long razor blade stored in one of the longitudinal slots of the base and deposits a dull razor blade in one of the empty longitudinal slots by placing the dull blade in an empty longitudinal slot and moving the knife in a direction that causes the dull razor blade to abut the blade stop corresponding to the slot in which the blade is placed.

26. A cutting system as defined in claim 20, whrein the blade-gripping member of the knife is fabricated from a graphite fiber composite material.

* * * * *